US009890486B2

(12) United States Patent
Yu

(10) Patent No.: US 9,890,486 B2
(45) Date of Patent: Feb. 13, 2018

(54) LOOP CUTTING APPARATUS FOR CIRCULAR KNITTING MACHINES

(71) Applicant: PAI LUNG MACHINERY MILL CO., LTD., New Taipei (TW)

(72) Inventor: Jen Wei Yu, New Taipei (TW)

(73) Assignee: Pai Lung Machinery Mill Co., Ltd., New Taipei (TW)

( * ) Notice: Subject to any disclaimer, the term of this patent is extended or adjusted under 35 U.S.C. 154(b) by 489 days.

(21) Appl. No.: 14/280,915

(22) Filed: May 19, 2014

(65) Prior Publication Data

US 2015/0329999 A1 Nov. 19, 2015

(51) Int. Cl.
*D04B 9/12* (2006.01)
*D04B 15/60* (2006.01)
*D04B 15/68* (2006.01)

(52) U.S. Cl.
CPC ..... *D04B 9/12* (2013.01); *D04B 15/60* (2013.01); *D04B 15/68* (2013.01)

(58) Field of Classification Search
CPC ..... D04B 9/12; D04B 15/60; D04B 15/68; D04B 9/14; D04B 15/61; D04B 15/58
USPC ..... 66/92, 91, 80, 140 R
See application file for complete search history.

(56) References Cited

U.S. PATENT DOCUMENTS 2,139,754 A * 12/1938 Houseman ..... D04B 9/26 66/140 R
2,892,331 A * 6/1959 Kelly ..... D04B 23/08 66/147
3,041,859 A * 7/1962 Brede ..... D04B 1/02 66/92
3,596,479 A * 8/1971 Remlinger ..... D04B 9/54 66/140 R
3,874,197 A * 4/1975 Plath ..... D04B 1/02 66/116
4,043,151 A * 8/1977 Schmidt ..... D04B 1/02 66/194
4,103,518 A * 8/1978 Lombardi ..... D04B 1/02 66/107

(Continued)

FOREIGN PATENT DOCUMENTS

CN 201136946 Y 10/2008
CN 201546011 U 8/2010

(Continued)

*Primary Examiner* — Danny Worrell
(74) *Attorney, Agent, or Firm* — Muncy, Geissler, Olds & Lowe, P.C.

(57) ABSTRACT

A loop cutting apparatus for a circular knitting machine which has a circular cylinder including a plurality of knitting needles movable independently includes an upper needle dial located on the circular cylinder and a plurality of yarn cutting needle sets radially centered about the axis of the circular cylinder. Each yarn cutting needle set includes a first cutter needle and a second cutter needle movable against the first cutter needle in a first yarn cutting displacement thereof. The first cutter needle has a yarn holding section leaned by a yarn and collaborated with the two abutting knitting needles at two sides to pick up and draw the yarn to form a pile loop and a first cutter section connected to the yarn holding section. The second cutter needle has a second cutter section staggered against the first cutter section in the first yarn cutting displacement to cut the pile loop.

7 Claims, 16 Drawing Sheets

(56) References Cited

U.S. PATENT DOCUMENTS 4,127,013 A * 11/1978 Nuber ..... D04B 1/02 66/121
4,409,800 A * 10/1983 Gutschmit ..... D04B 1/02 66/136
4,537,048 A * 8/1985 Gutschmit ..... D04B 1/02 66/93
4,592,212 A * 6/1986 Schmidt ..... D04B 35/02 66/91
5,109,680 A * 5/1992 Pernick ..... D04B 1/02 66/193
5,167,133 A * 12/1992 Schmidt ..... D04B 9/12 66/9 R
5,239,843 A * 8/1993 Plath ..... D04B 15/06 66/104
5,463,882 A * 11/1995 Yeh ..... D04B 15/06 66/90
5,791,162 A * 8/1998 Plath ..... D04B 1/02 66/104
5,862,681 A * 1/1999 Schmidt ..... D04B 1/02 66/106
6,094,944 A * 8/2000 Schmidt ..... D04B 23/08 66/90
6,125,662 A * 10/2000 Bizer ..... D04B 9/12 66/191
6,128,930 A * 10/2000 Schmidt ..... D04B 35/02 66/91
6,269,665 B1 * 8/2001 Wang ..... D04B 9/12 66/107
7,127,920 B1 * 10/2006 Su ..... D04B 9/12 66/92
7,146,829 B1 * 12/2006 Su ..... D04B 9/12 66/92
7,757,516 B1 * 7/2010 Starbuck ..... D04B 15/06 66/104
2003/0154747 A1 * 8/2003 Plath ..... D04B 1/02 66/8
2006/0236726 A1 * 10/2006 Hagens ..... D04B 35/02 66/120
2009/0249836 A1 * 10/2009 Stingel ..... D04B 15/06 66/104

FOREIGN PATENT DOCUMENTS

DE 19518490 A 11/1996
TW 205225 5/1993
TW 208294 6/1993

* cited by examiner

LOOP CUTTING APPARATUS FOR CIRCULAR KNITTING MACHINES

FIELD OF THE INVENTION

The present invention relates to a loop cutting apparatus for circular knitting machines and particularly to a loop cutting apparatus for circular knitting machines that cuts a pile loop immediately after it is formed.

BACKGROUND OF THE INVENTION

Fabrics with fine pile provide the look and touch feel of furs or pelts, hence are appealing to consumers. Conventional circular knitting machines that can knit fine plush fabrics, like U.S. Pat. Nos. 7,146,829 and 7,127,920, include a cylinder with a plurality of latch-less needles located thereon, a needle dial contained a plurality of latch needles and a plurality of sinkers. The sinkers are located on a sinker holder circulating the cylinder. Each sinker has a cutter at the front end. The sinker is driven by a cam on the sinker holder to slide toward the cylinder, and the cutter on the sinker severs a pile loop formed by a yarn to form a pile. References of other types of circular knitting machines that can knit fine pile fabrics also can be found in PRC patents Nos. CN201136946 and CN201546011, Germany patent No. DE19518490, U.S. Pat. Nos. 4,592,212 and 6,094,944. However, the conventional circular knitting machines that can produce fine pile fabrics require to add a sinker holder around the cylinder, hence significantly increase the total size of the circular knitting machines and the number of components required. As a result, the circular knitting machines are complex in structure, and fabrication and assembly also are more difficult.

Aside from severing the pile loops via the sinkers, the circular knitting machine can also be equipped with blade-contained needles to cut the pile loops. For instance, R.O.C. patents Nos. 205255 and 208294 disclose a pile cutting apparatus. It has multiple sets of vertical cutter needles, horizontal knitting needles and horizontal sinkers located on a cylinder of a knitting machine. These three sets of elements can be moved in collaborated displacements so that the knitting needles can pick up yarns to form loops in cutter needle slots, then the sinkers move forwards to press the surface of the loops and the cutter needles are moved upwards to the apex, and the blades at the lower end of the slots sever the pile loops. However, in order to push the cutter needle to the apex its travel path has to increase, that means that the time to cut each pile loop is longer, that adversely affects the knitting efficiency of the fine pile fabrics.

SUMMARY OF THE INVENTION

The primary object of the present invention is to solve the problems of the conventional knitting machines for knitting fine pile fabrics of requiring an additional and complex pile loop cutting apparatus and lower efficiency in knitting the fine pile fabrics.

To achieve the foregoing object the present invention provides a loop cutting apparatus for circular knitting machines adopted for use on a circular knitting machine. The circular knitting machine has a circular cylinder and a yarn conveying system to provide a plurality of yarns to the circular cylinder. The circular cylinder has a plurality of first needle slots parallel with the axis of the circular cylinder and a plurality of knitting needles located in the first needle slots and movable independently. The loop cutting apparatus includes an upper needle dial and a plurality of yarn cutting needle sets. The upper needle dial has a plurality of second needle slots radially centered about the axis of the circular cylinder and corresponding to the first needle slots. Each yarn cutting needle set includes a first cutter needle and a second cutter needle in parallel with the first cutter needle and movable against the first cutter needle in a first yarn cutting displacement thereof. The first cutter needle is located between two neighboring knitting needles. The first cutter needle has a yarn holding section leaned by the yarn and collaborated with the abutting knitting needles at two sides to pick up and draw the yarn to form a pile loop and a first cutter section connected to the yarn holding section. The second cutter needle has a second cutter section staggered against the first cutter section in the first yarn cutting displacement to cut the pile loop.

In one embodiment the first cutter section of the first cutter needle inclines away from the knitting needles, and the second cutter section of the second cutter needle is bent towards the first cutter needle.

In another embodiment the first yarn cutting displacement includes a first middle displacement with a closed yarn cutting space among the first cutter section, second cutter section and yarn holding section to hold the yarn.

In yet another embodiment the first cutter section inclines towards the knitting needles, and the second cutter section is bent towards the first cutter needle.

In yet another embodiment the first yarn cutting displacement includes a second middle displacement with an open yarn cutting space between the first cutter section and second cutter section that has an upper opening to hold the yarn.

In yet another embodiment the first cutter needle includes a first distal end towards the knitting needles that contains the first cutter section.

In yet another embodiment the first cutter needle has a first yarn laying displacement moved towards the knitting needles to lean on the yarn.

The invention further provides a loop cutting apparatus for circular knitting machines adopted for use on a circular knitting machine. The circular knitting machine has a circular cylinder and a yarn conveying system to provide a plurality of yarns to the circular cylinder. The circular cylinder has a plurality of first needle slots parallel with the axis of the circular cylinder. The loop cutting apparatus includes an upper needle dial on the circular cylinder and a plurality of yarn cutting needle sets. The upper needle dial has a plurality of second needle slots radially centered about the axis of the circular cylinder corresponding to the first needle slots and a plurality of knitting needles located in the second needle slots and movable independently. The yarn cutting needle sets are located in the first needle slots. Each yarn cutting needle set includes a first cutter needle and a second cutter needle in parallel with the first cutter needle and movable against the first cutter needle in a second yarn cutting displacement. The first cutter needle is located between two neighboring knitting needles. The first cutter needle has a yarn holding section leaned by the yarn and collaborated with the abutting knitting needles at two sides to pick up and draw the yarn to form a pile loop and a first cutter section connected to the yarn holding section. The second cutter needle has a second cutter section staggered against the first cutter section in the second yarn cutting displacement to cut the pile loop.

The yarn cutting apparatus of the invention can have the yarn cutting needle sets selectively mounted onto the circular cylinder or the upper needle dial. Through the movable first cutter needle and second cutter needle in each yarn cutting needle set, the yarn of the pile loop is in contact at the same time with the first cutter section of the first cutter needle and second cutter section of the second cutter needle, and is shorn at two sides to sever the pile loop. Compared with the conventional circular knitting machines for knitting fine pile fabrics, the invention does not need an extra sinker holder to guide the sinkers and also does not need to extend the travel path of the cutter needle, thus space utilization of the circular knitting machine is more efficient and the efficiency of knitting the fine pile fabrics also improves.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
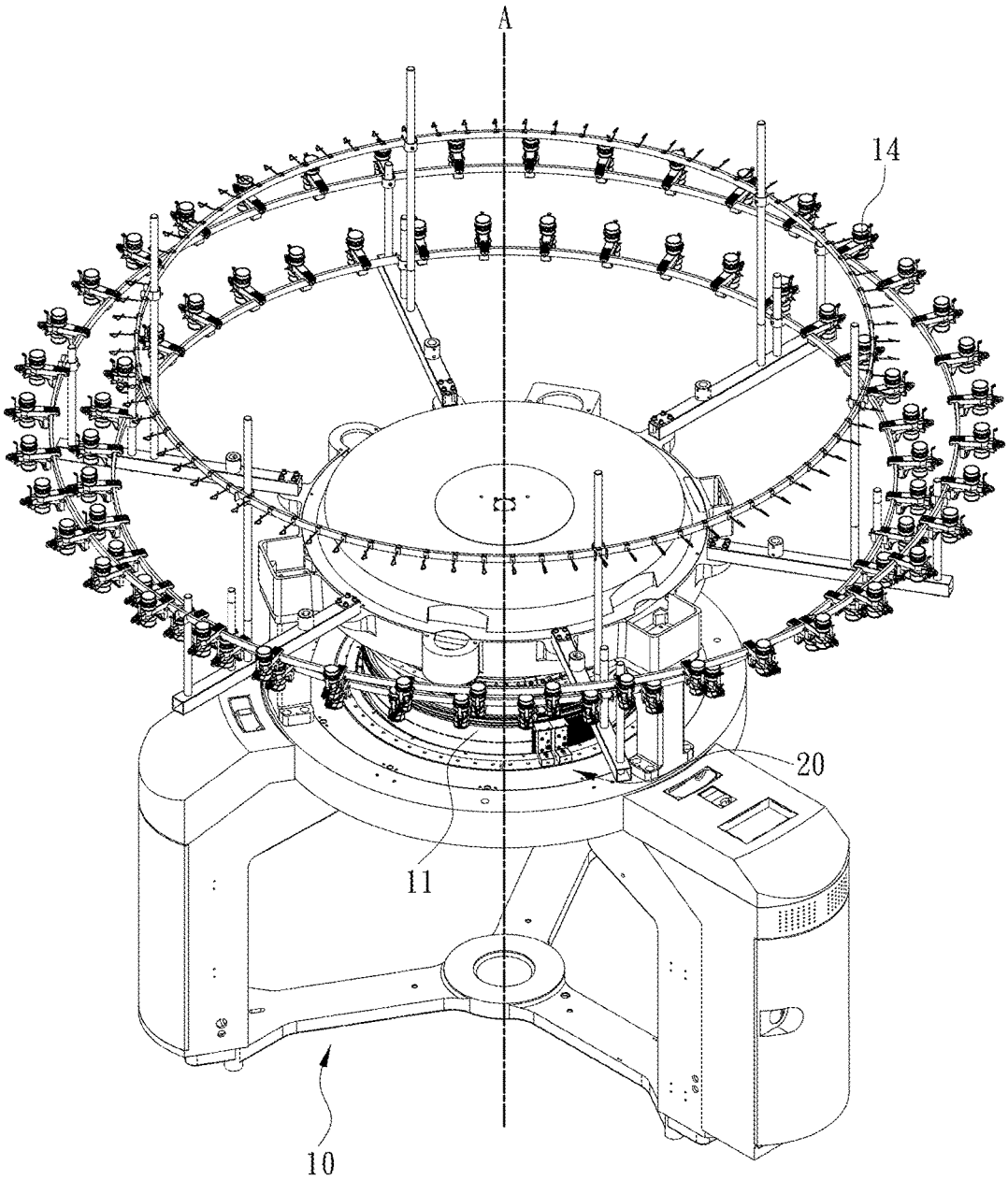
FIG. 1 is a holistic view of an embodiment of the invention adopted on a circular knitting machine.
Figure 2:
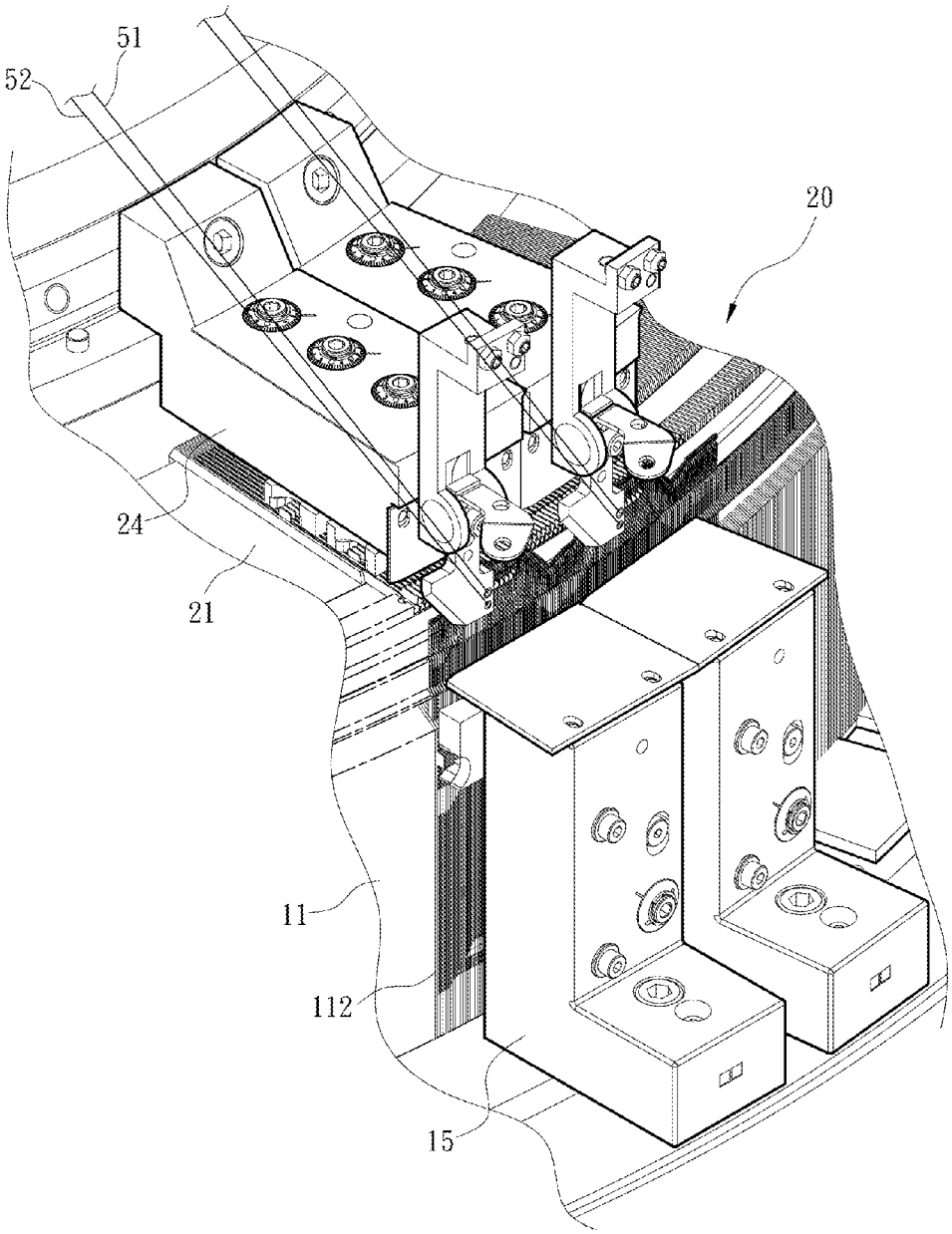
FIG. 2 is a perspective view of an embodiment of the loop cutting apparatus of the invention.

Please refer to FIGS. 1 through 4 for an embodiment of a loop cutting apparatus of the invention adopted on a circular knitting machine. The loop cutting apparatus 20 of the invention is used on a circular knitting machine 10 to knit fine pile fabrics which have a pile surface and a ground fabric to hold the pile surface. The circular knitting machine 10 has a circular cylinder 11 with an axis A and a yarn conveying system 14 to provide a plurality of yarns to the circular cylinder 11. The yarns include at least one first yarn 51 (generally called pile yarn) to form the annular yarn surface and at least one second yarn 52 (generally called ground yarn) to form the ground fabric. The circular cylinder 11 has a plurality of first needle slots 111 parallel with the axis A of the circular cylinder 11 and a plurality of knitting needles 112 located in the first needle slots 111 and movable independently. In this invention the knitting needles 112 can be moved and controlled through a lower cam set 15 at the periphery of the circular cylinder 11 like the conventional techniques do. The lower cam set 15 has a corresponding control track (not shown in the drawings) corresponding to a protrusion 113 of each knitting needle 112 (also referring to FIG. 5A). The lower cam set 15 can move against the circular cylinder 11, and the protrusion 113 is driven by the control track so that the knitting needle 112 also is moved in one first needle slot 111. The loop cutting apparatus 20 includes an upper needle dial 21 located on the circular cylinder 11 and a plurality of yarn cutting needle sets located on the upper needle dial 21. The upper needle dial 21 has a plurality of second needle slots 211 radially centered about the axis A of the circular cylinder 11 corresponding to the first needle slots 111. Each yarn cutting needle set is held in one second needle slot 211.

Each yarn cutting needle set includes a first cutter needle 22 and a second cutter needle 23 parallel with the first cutter needle 22 and movable against the first cutter needle 22 in a first yarn cutting displacement P thereof. The first cutter needle 22 has a first distal end 221 towards the knitting needles 112 and a yarn holding section 222 leaned by the first yarn 51, a first cutter section 223 located at the first distal end 221 and connected to the yarn holding section 222 and a first control bump 224. The second cutter needle 23 has a second cutter section 231 staggered against the first cutter section 223 in the first yarn cutting displacement P and a second control bump 232. In this invention the first cutter needle 22 and second cutter needle 23 can be moved and controlled by an upper cam set 24 on the upper needle dial 21 like in the conventional techniques do. The upper cam set 24 has a plurality of control tracks (not shown in the drawings) corresponding to the first control bump 224 and second control bump 232. When the upper cam set 24 is moved against the upper needle dial 21 the first control bump 224 and second control bump 232 are driven by the control tracks to move the first cutter needle 22 and second cutter needle 23.

Figure 3:
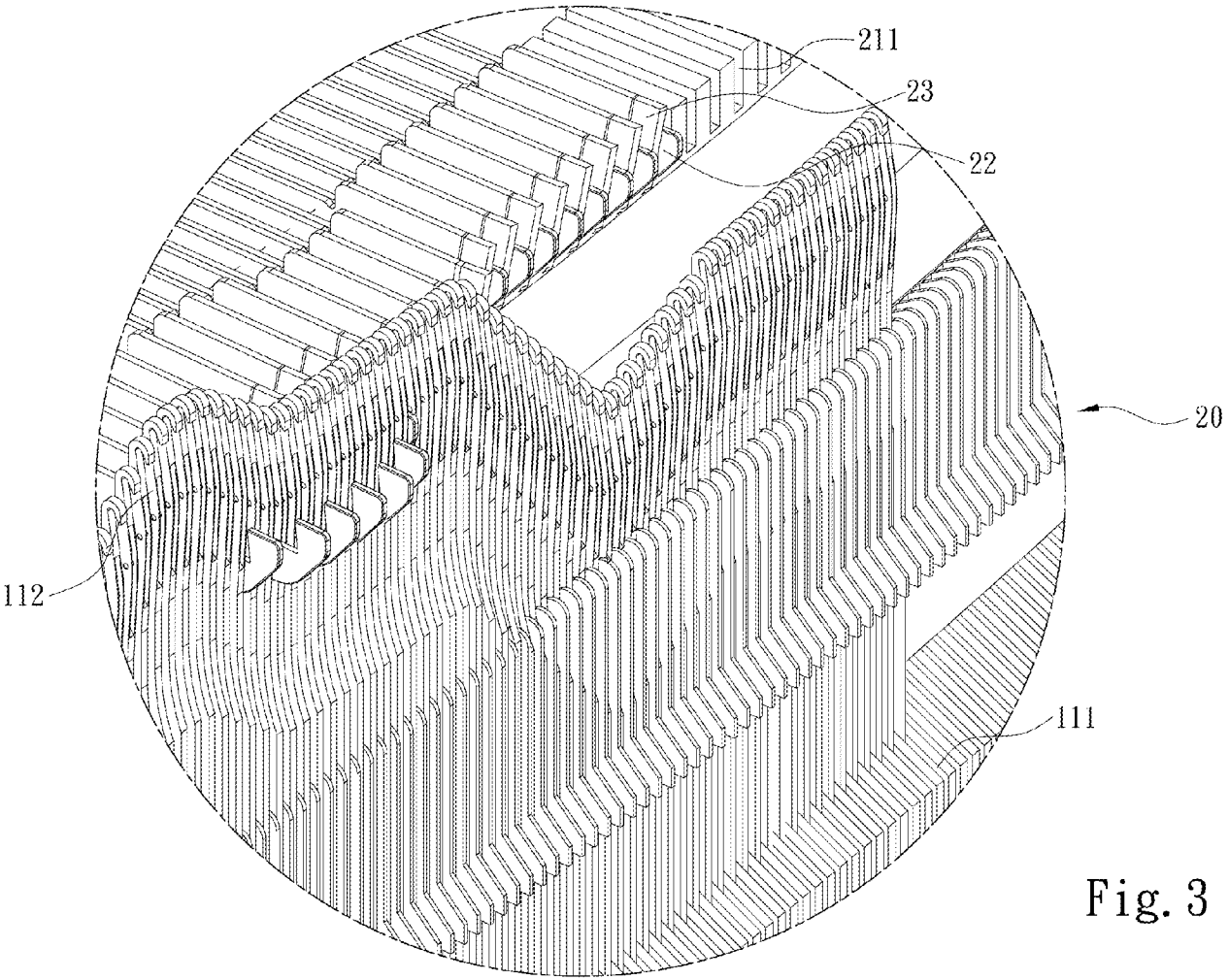
FIG. 3 is a fragmentary perspective view of an embodiment of the loop cutting apparatus of the invention.
Figure 4:
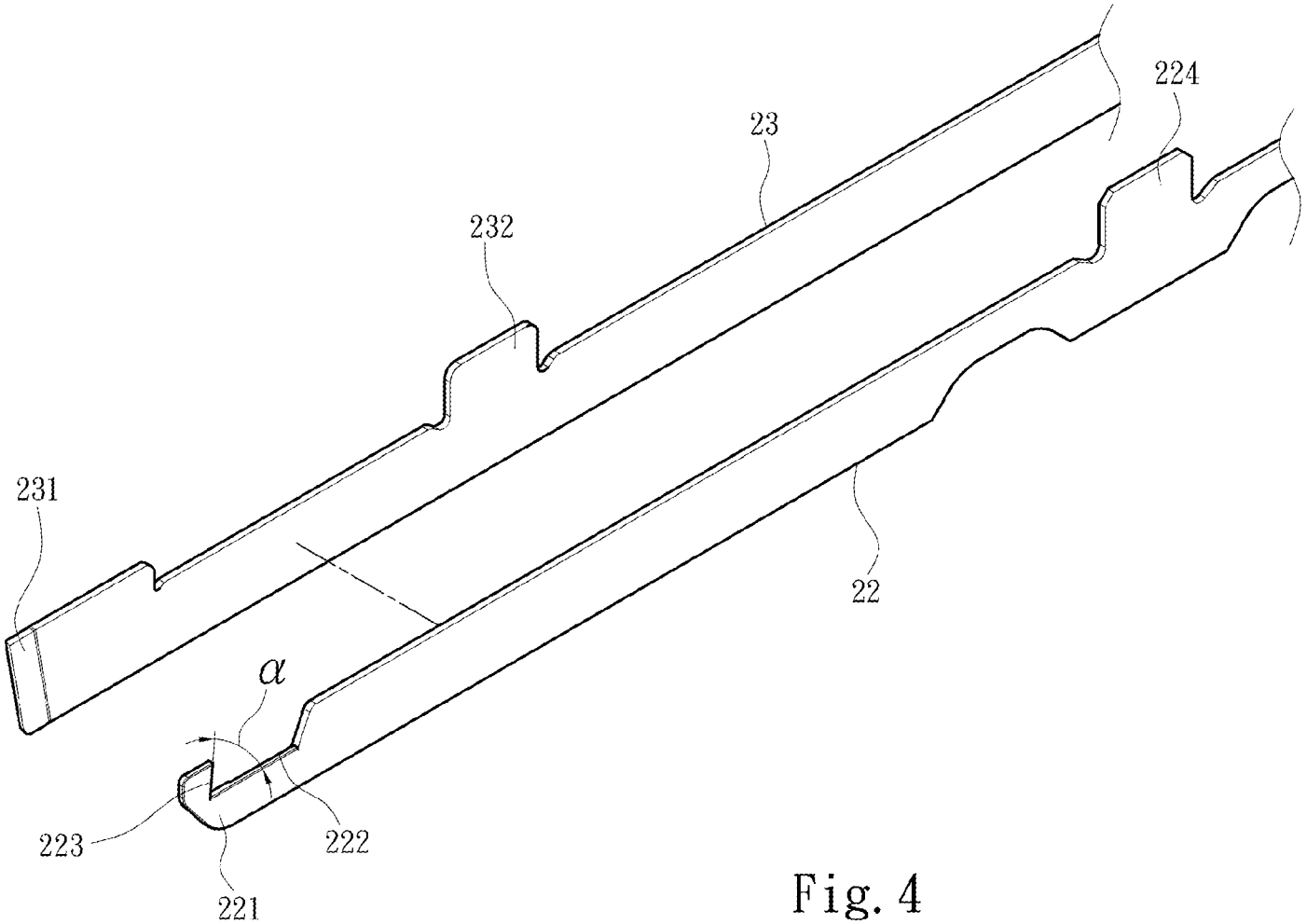
FIG. 4 is a perspective view of an embodiment of the yarn cutting needle set of the invention.
Figure 5A:
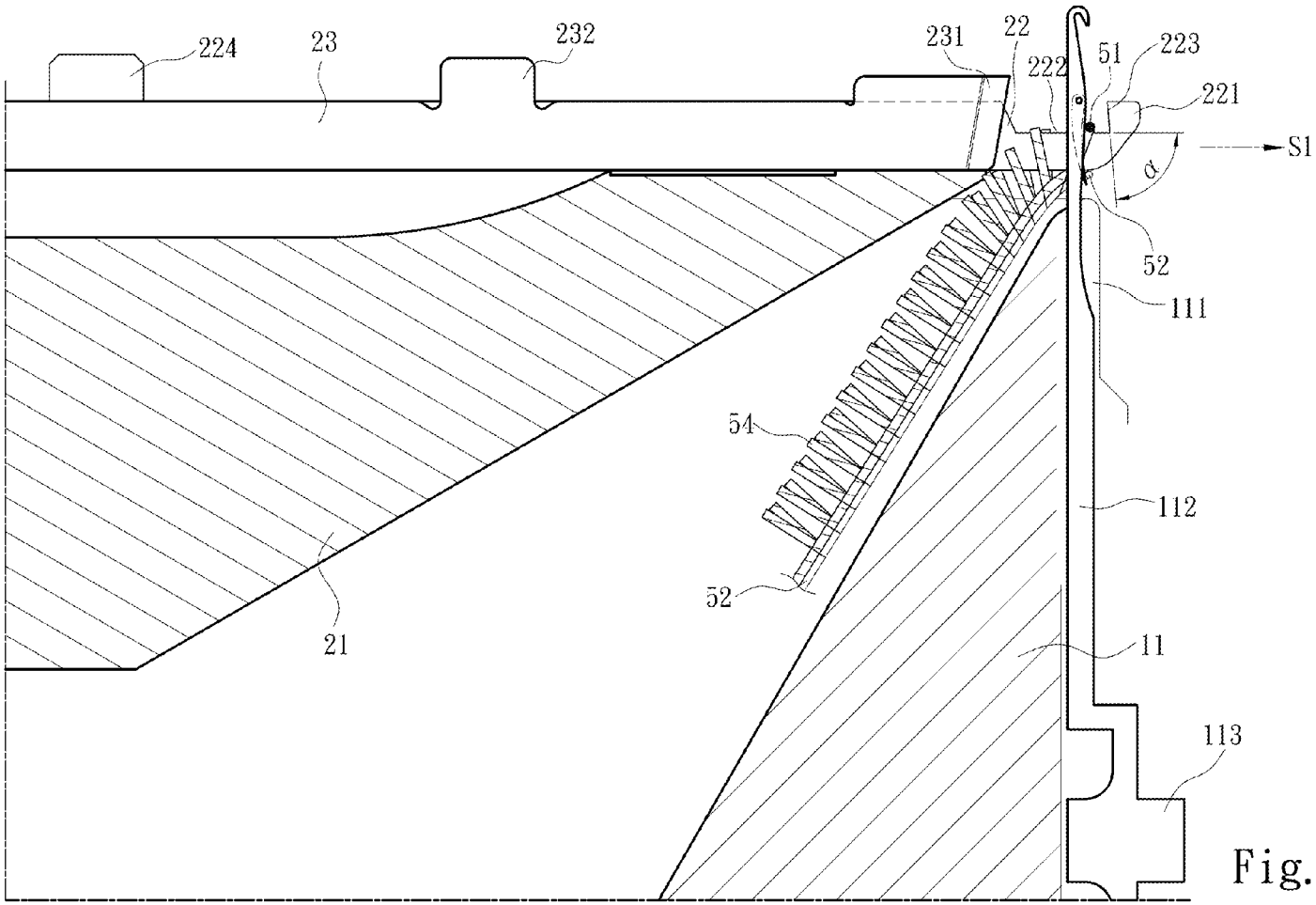
FIGS. 5A through 5D are schematic views of an embodiment of the yarn cutting needle set of the invention in loop cutting processes.

In this embodiment, referring to FIGS. 3, 4 and 5A, the first cutter section 223 of the first cutter needle 22 inclines away from the knitting needles 112, and the first cutter section 223 and yarn holding section 222 form a first included angle $\alpha$ smaller than 90 degrees between them. The second cutter section 231 of the second cutter needle 23 is bent towards the first cutter needle 22, even can be bent in contact with the first cutter needle 22.

Figure 5B:
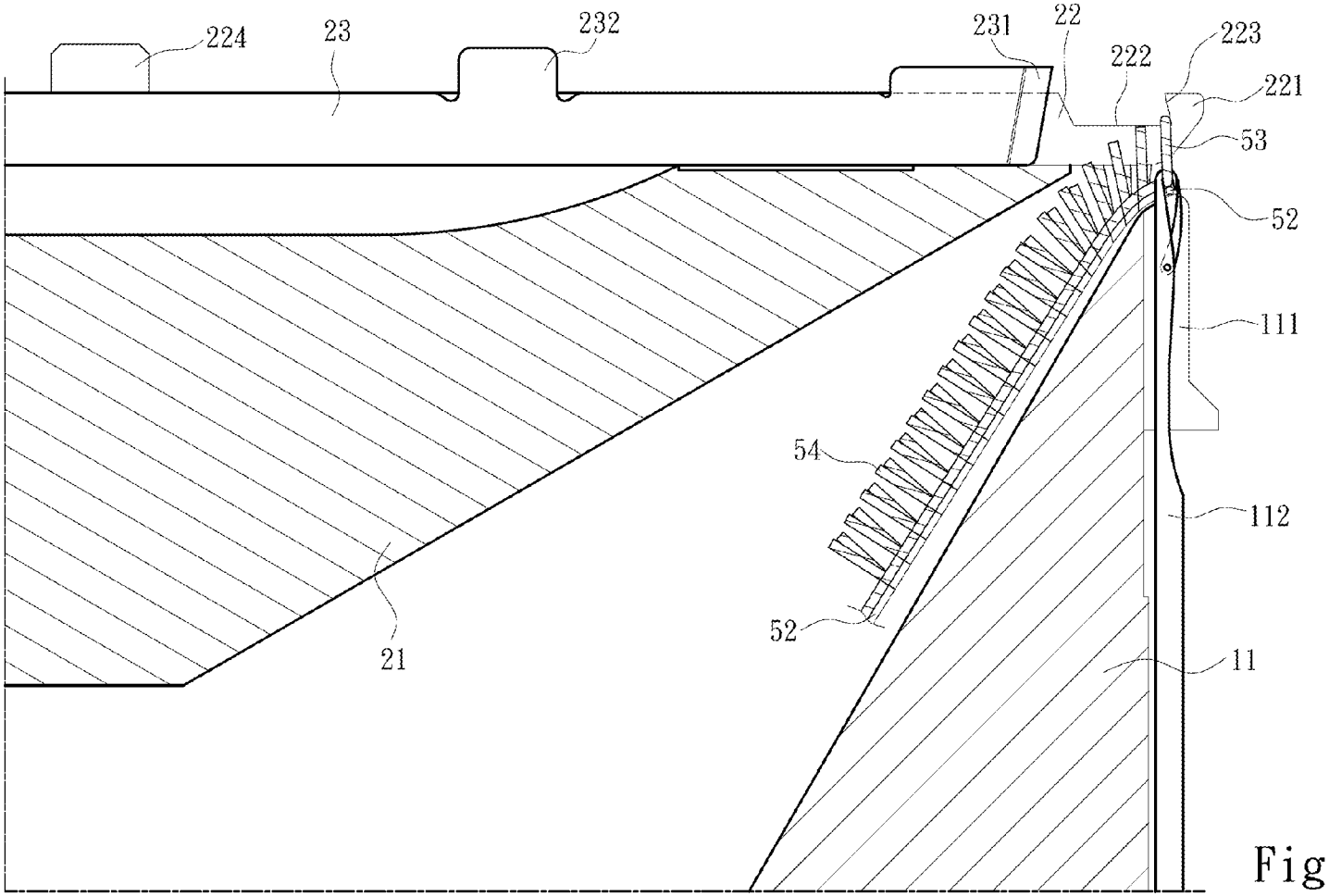
Figure 5C:
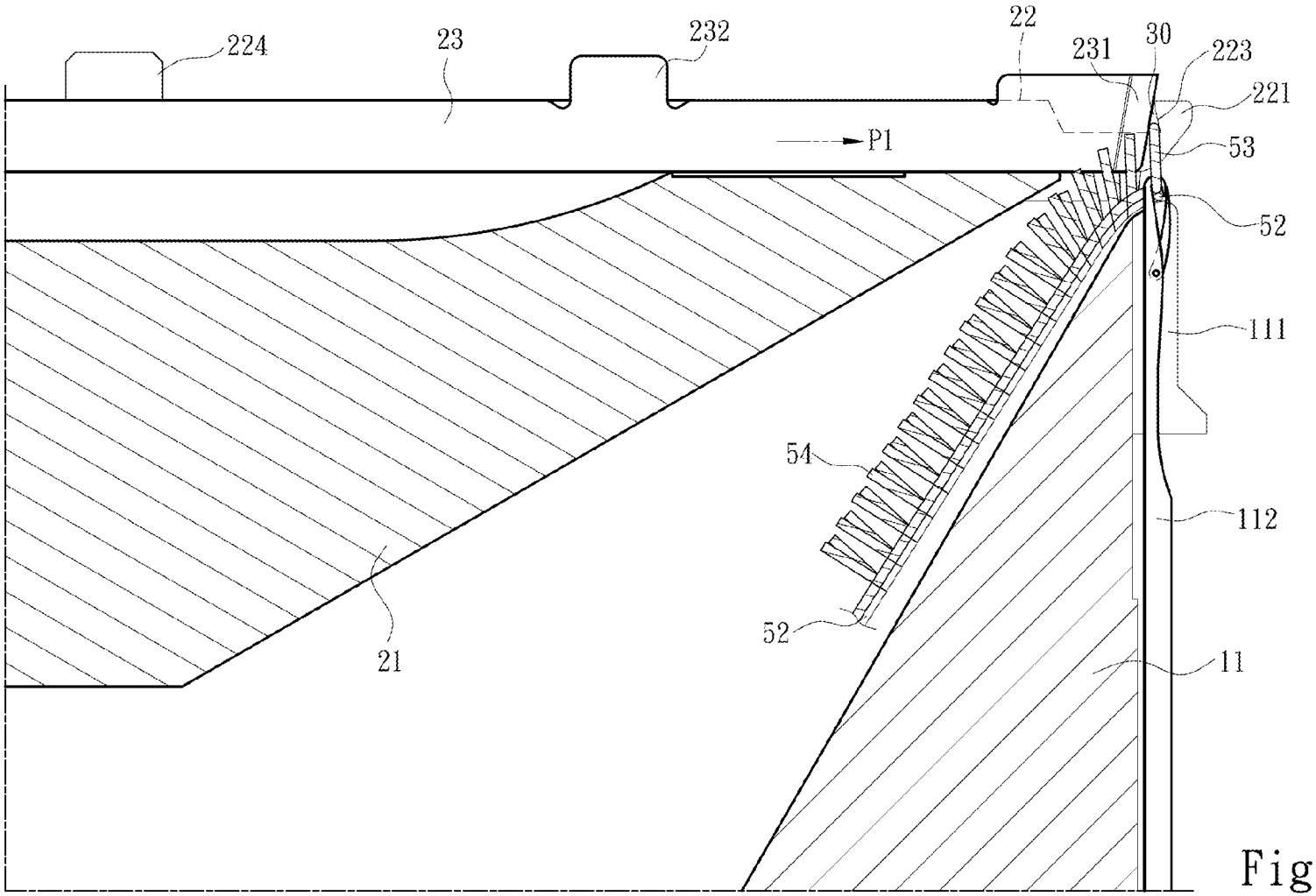
Figure 5D:
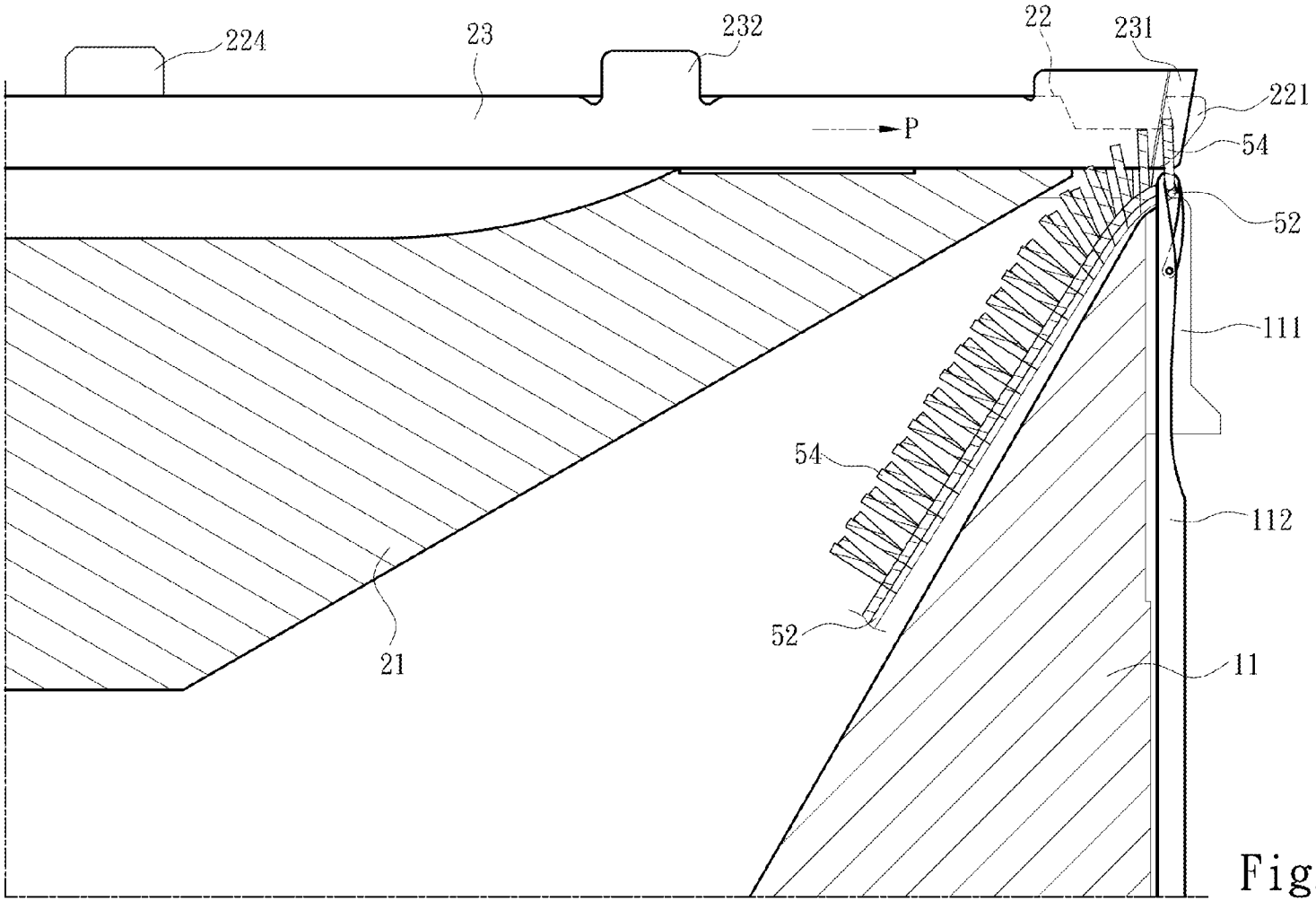

Please refer FIGS. 5A through 5D for an embodiment of the loop cutting apparatus of the invention in loop cutting processes. First, the yarn conveying system 14 guides the first yarn 51 and second yarn 52 to the circular cylinder 11; the first cutter needle 22 is controlled by the upper cam set 24 to move towards the knitting needles 112 to proceed a first yarn laying displacement S1; the first yarn 51 leans on the yarn holding section 222 of the first cutter needle 22 as shown in FIG. 5A; the second yarn 52 passes through below the yarn holding section 222. Since each first cutter needle 22 is located between two abutting knitting needles 112, when the knitting needles 112 are driven by the lower cam set 15 to move downwards as shown in FIG. 5B, the first yarn 51 leaned on the yarn holding section 222 and the second yarn 52 located below the yarn holding section 222 are picked up together by the knitting needles 112 at the two sides; because of the distance between the yarn holding section 222 and the first yarn 51 picked up by the knitting needles 112 a pile loop 53 is formed, and the second yarn 52 winds around and holds the bottom of the pile loop 53; next, the second cutter needle 23 is controlled by the upper cam set 24 to proceed the first yarn cutting displacement P. During the second cutter needle 23 is in the first yarn cutting displacement P, namely, the first cutter section 223 and second cutter section 231 start in a staggered manner, as shown in FIG. 5C, the first cutter section 223, second cutter section 231 and yarn holding section 222 form a first middle displacement P1 with a closed yarn cutting space 30 among them to hold the first yarn 51. When the second cutter needle 23 continuously proceeds the first yarn cutting displacement P, the first cutter section 223 and second cutter section 231 are in contact respectively to two sides of the first yarn 51 to form two-side cutting like scissors. After the second cutter needle 23 has finished the first yarn cutting displacement P to sever the pile loop 53 a pile 54 is formed as shown in FIG. 5D. In this embodiment first yarn 51 is held in the closed yarn cutting space 30 formed among the first cutter section 223, second cutter section 231 and yarn holding section 222, hence can be securely shorn to form the pile 54.

Figure 6A:
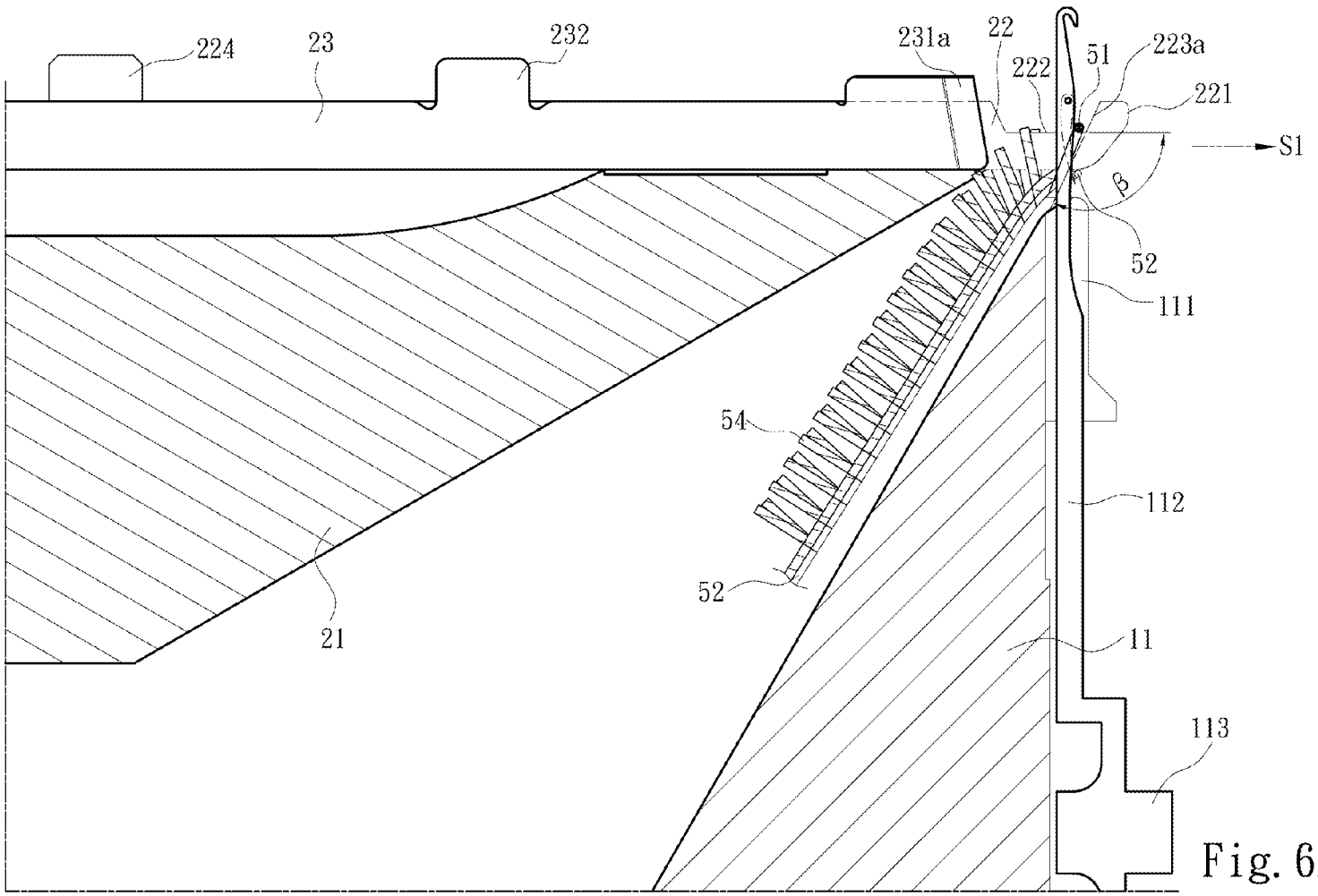
FIGS. 6A through 6D are schematic views of another embodiment of the yarn cutting needle set of the invention in loop cutting processes.

Please refer to FIG. 6A for another embodiment of the invention. The first cutter section 223*a* of the first cutter needle 22 inclines towards the knitting needles 112, and the first cutter section 223*a* and yarn holding section 222 form a second included angle β greater than 90 degrees between them. The second cutter section 231*a* of the second cutter needle 23 is bent towards the first cutter needle 22, or even bent in contact with the first cutter needle 22.

Figure 6B:
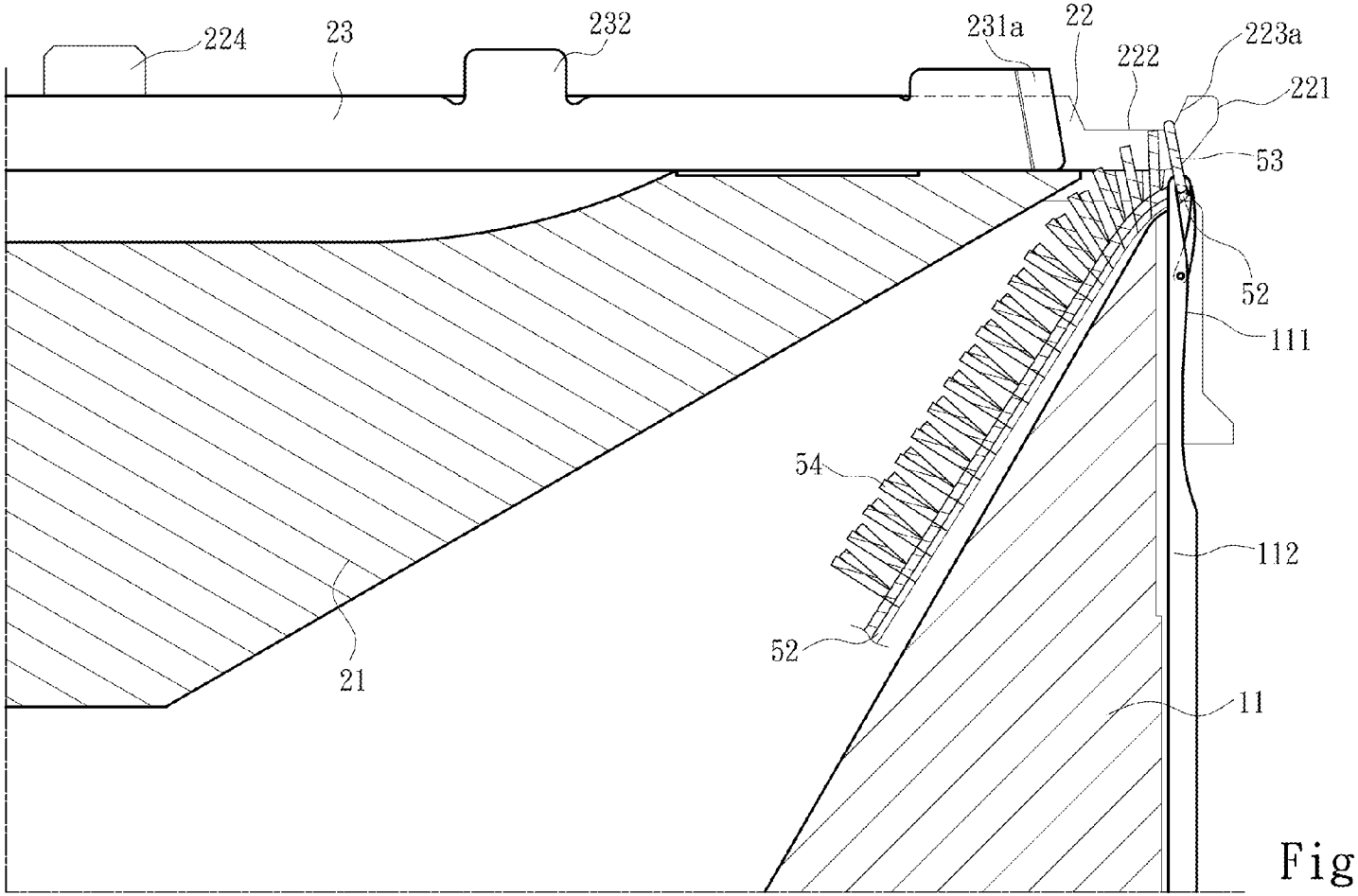
Figure 6C:
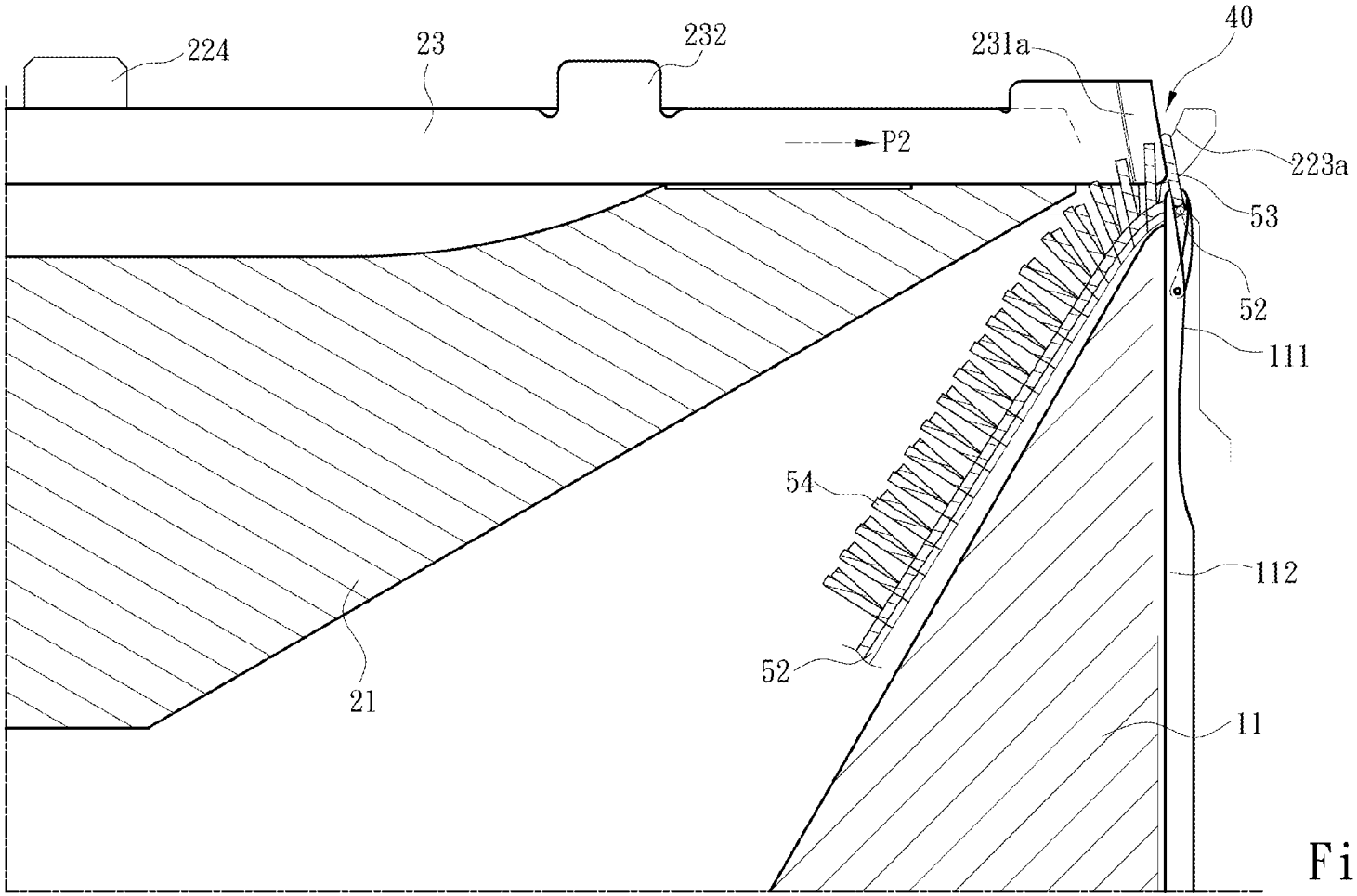
Figure 6D:
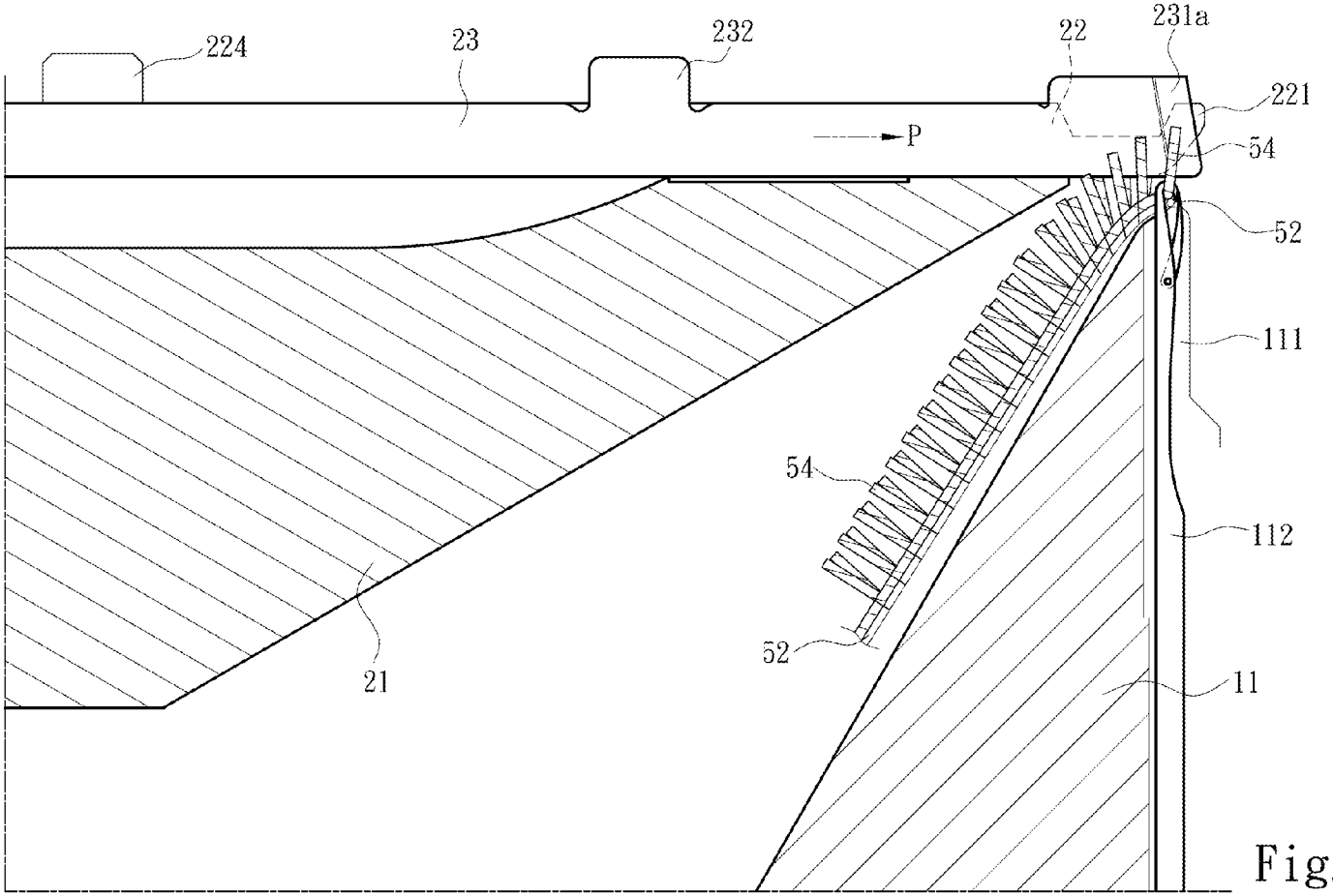

Please refer FIGS. 6A through 6D for the another embodiment of the loop cutting apparatus of the invention in loop cutting processes. First, the yarn conveying system 14 guides the first yarn 51 and second yarn 52 to the circular cylinder 11; the first cutter needle 22 is controlled by the upper cam set 24 to move towards the knitting needle 112 to proceed a first yarn laying displacement S1; the first yarn 51 leans on the yarn holding section 222 of the first cutter needle 22 as shown in FIG. 6A; the second yarn 52 passes through below the yarn holding section 222. Since each first cutter needle 22 is located between two abutting knitting needles 112, when the knitting needles 112 are driven by the lower cam set 15 to move downwards as shown in FIG. 6B, the first yarn 51 leaned on the yarn holding section 222 and the second yarn 52 located below the yarn holding section 222 are picked up together by the knitting needles 112 at the two sides; because of the distance between the yarn holding section 222 and the first yarn 51 picked up by the knitting needles 112 a pile loop 53 is formed, and the second yarn 52 winds around and holds the bottom of the pile loop 53; next, the second cutter needle 23 is controlled by the upper cam set 24 to proceed the first yarn cutting displacement P. During the second cutter needle 23 is in the first yarn cutting displacement P, namely, the first cutter section 223 and second cutter section 231 start in a staggered manner, as shown in FIG. 6C, the first cutter section 223, and second cutter section 231 form a second middle displacement P2 with an open yarn cutting space 40 between them with an upper opening to hold the first yarn 51. When the second cutter needle 23 continuously proceeds the first yarn cutting displacement P, the first cutter section 223 and second cutter section 231 are in contact respectively to two sides of the first yarn 51 to form two-side cutting like scissors. After the second cutter needle 23 has finished the first yarn cutting displacement P to sever the pile loop 53 a pile 54 is formed as shown in FIG. 6D.

Figure 7A:
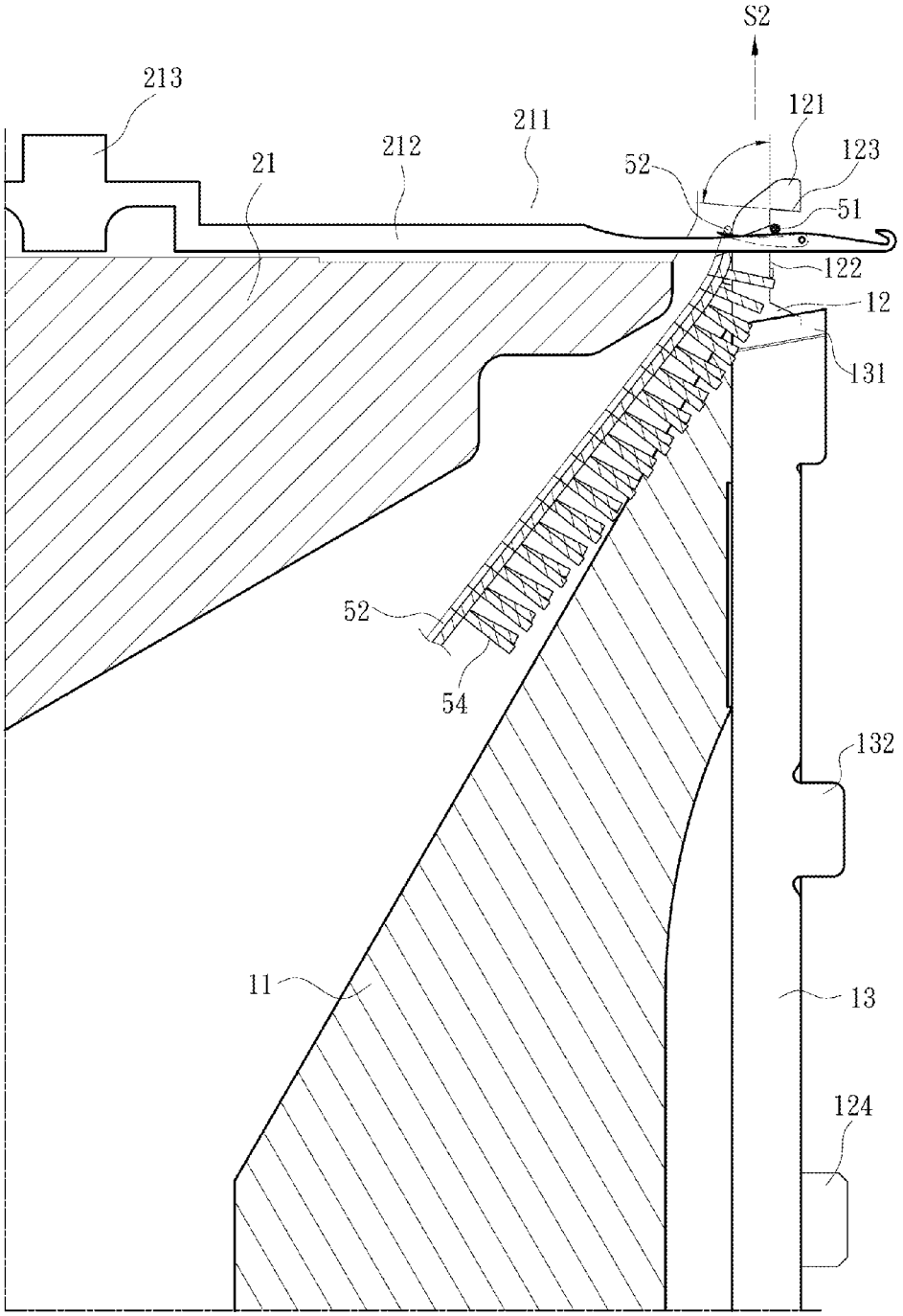
FIGS. 7A through 7D are schematic views of yet another embodiment of the loop cutting apparatus of the invention in loop cutting processes

Please refer to FIG. 7A for yet another embodiment of the invention. The upper needle dial 21 includes a plurality of knitting needles 212 in the second needle slots 211 that are movable independently. The circular cylinder 11 has a plurality of yarn cutting needle sets located in the first needle slots 111. Each yarn cutting needle set includes a first cutter needle 12 and a second cutter needle 13 parallel with the first cutter needle 12 and movable upward against the first cutter needle 12 in a second yarn cutting displacement Q. The first cutter needle 12 has a first distal end 121 towards the knitting needles 112 and a yarn holding section 122 leaned by the first yarn 51, a first cutter section 123 located at the first distal end 121 and connected to the yarn holding section 122 and a first control bump 124. The second cutter needle 13 has a second cutter section 131 staggered against the first cutter section 123 in the second yarn cutting displacement Q and a second control bump 132. In this embodiment the first cutter needle 12 and second cutter needle 13 can be moved and controlled by a lower cam set 15 at the periphery of the circular cylinder 11 like in the conventional techniques. The lower cam set 15 has control tracks (not shown in the drawings) corresponding to the first control bump 124 and second control bump 132. Movements of the knitting needles 212 can be controlled by the upper cam set 24 on the upper needle dial 21. The upper cam set 24 has a plurality of control tracks (not shown in the drawings) corresponding to the bump 213 of the knitting needles 212.

Figure 7B:
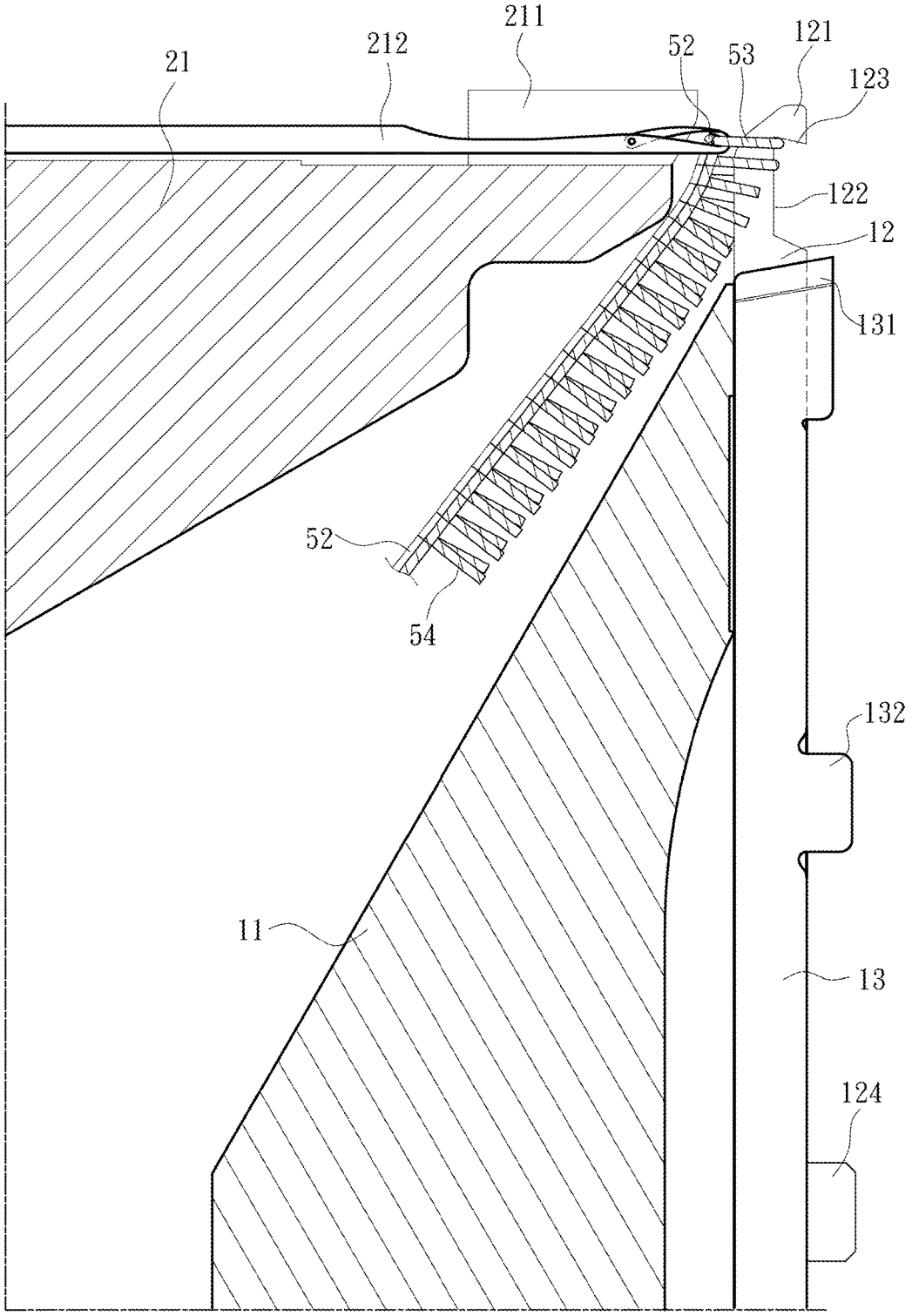
Figure 7C:
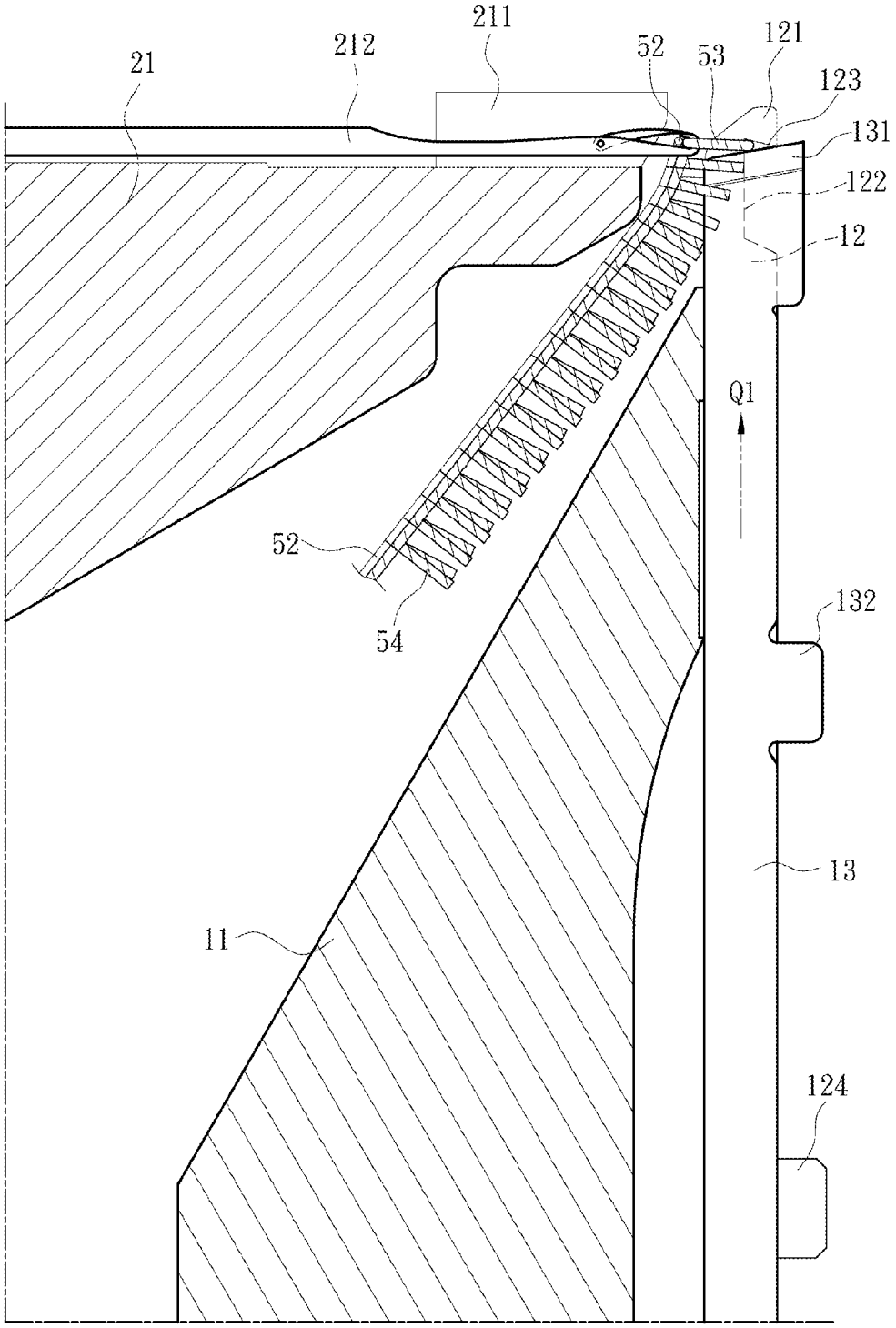
Figure 7D:
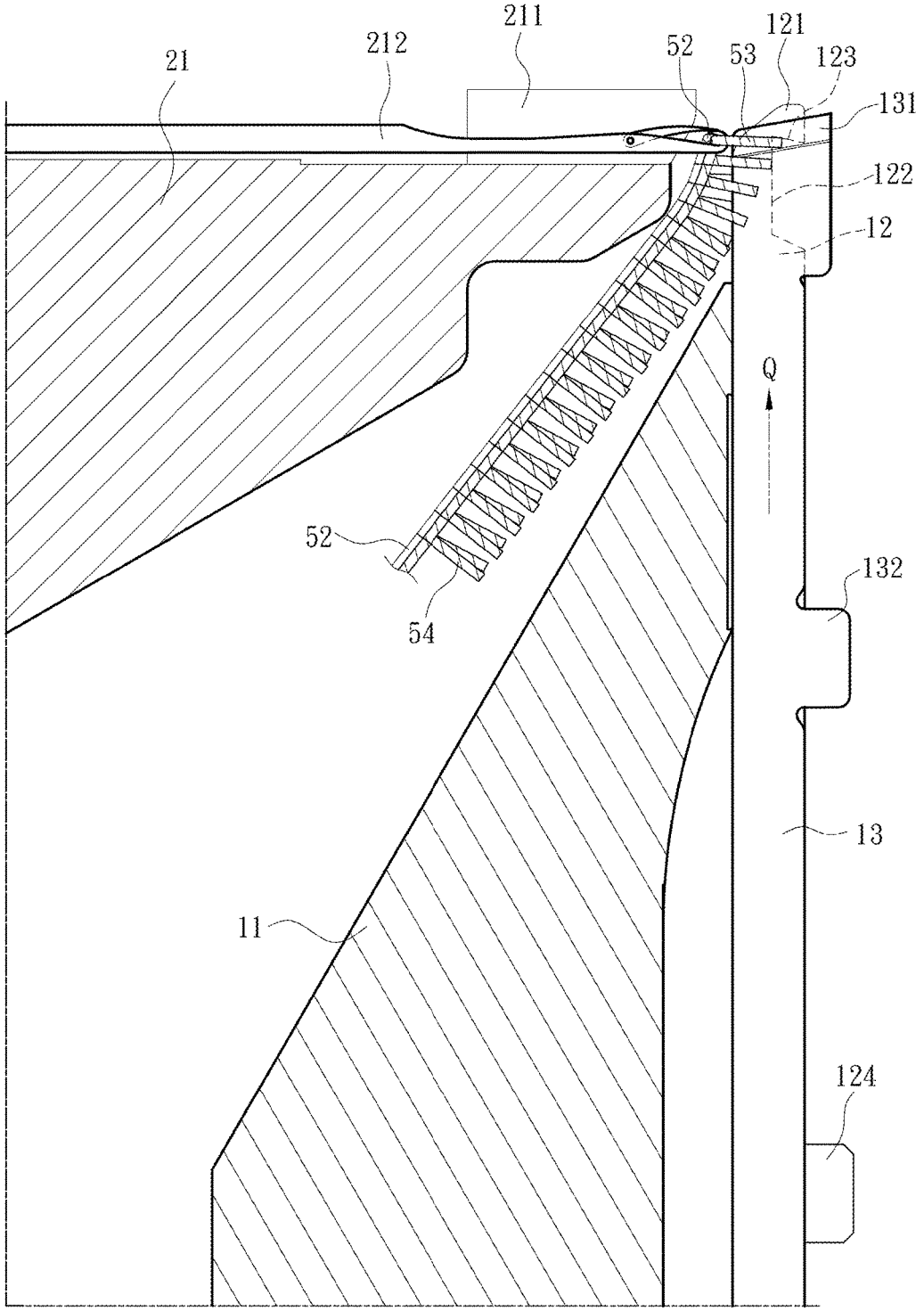

Please refer FIGS. 7A through 7D for the yet another embodiment of the loop cutting apparatus of the invention in loop cutting processes. First, the yarn conveying system 14 guides the first yarn 51 and second yarn 52 to the circular cylinder 11; the first cutter needle 12 is controlled by the lower cam set 15 to move towards the knitting needle 112 and upward to proceed a second yarn laying displacement S2; the first yarn 51 leans on the yarn holding section 122 of the first cutter needle 12 as shown in FIG. 7A; the second yarn 52 passes through below the yarn holding section 122. Since each first cutter needle 12 is located between two abutting knitting needles 212, when the knitting needles 212 are driven by the upper cam set 24 to move leftward as shown in FIG. 7B, the first yarn 51 leaned on the yarn holding section 122 and the second yarn 52 located below the yarn holding section 122 are picked up together by the knitting needles 212 at two sides; because of the distance between the yarn holding section 122 and the first yarn 51 picked up by the knitting needles 212 a pile loop 53 is formed, and the second yarn 52 winds around and holds the bottom of the pile loop 53; next, the second cutter needle 13 is controlled by the lower cam set 15 to proceed the second yarn cutting displacement Q. During the second cutter needle 13 is in the second yarn cutting displacement Q, namely, the first cutter section 123 and second cutter section 131 start in a staggered manner, as shown in FIG. 7C, the first cutter section 123, second cutter section 131 and yarn holding section 122 form a first middle displacement Q1 with a closed yarn cutting space 30 among them to hold the first yarn 51. When the second cutter needle 13 continuously proceeds the second yarn cutting displacement Q, the first cutter section 123 and second cutter section 131 are in contact respectively to two sides of the first yarn 51 to form two-side cutting like scissors. After the second cutter needle 13 has finished the second yarn cutting displacement Q to sever the pile loop 53 a pile 54 is formed as shown in FIG. 7D.

The loop cutting apparatus of the invention can have the yarn cutting needle sets selectively located on the circular cylinder or the upper needle dial. Through the first cutter needle and second cutter needle of each yarn cutting needle set that are movable against each other the first yarn of the pile loop can be in contact at the same time with the first cutter section of the first cutter needle and second cutter section of the second cutter needle, and the pile loop can be securely severed from two sides to form the fine pile without the problem of forming some non-severed pile loops. Compared with the conventional circular knitting machines for knitting fine pile fabrics the invention does not need an extra sinker holder to guide the sinkers, and also does not need to extend the travel path of the bladed knitting needles, thus space utilization the circular knitting machines is more efficient and knitting efficiency of the fine pile fabrics also improves.

What is claimed is:

1. A loop cutting apparatus for a circular knitting machine which includes a circular cylinder and a yarn conveying system to provide a plurality of yarns to the circular cylinder, the circular cylinder containing a plurality of first needle slots parallel with the axis of the circular cylinder and a plurality of knitting needles located in the first needle slots and movable independently, the loop cutting apparatus comprising:

an upper needle dial which is located on the circular cylinder and includes a plurality of second needle slots radially centered about the axis of the circular cylinder and corresponding to the first needle slots; and a plurality of yarn cutting needle sets which are located in the second needle slots, each yarn cutting needle set including a first cutter needle, which moves towards the knitting needle to proceed a first yarn laying displacement to lean on one of the plurality of yarns, and a second cutter needle, which is parallel with the first cutter needle and moves towards the knitting needle to proceed the movement against the first cutter needle in a first yarn cutting displacement thereof after the first cutter needle has finished the first yarn laying displacement, the first cutter needle including a first distal end which faces the knitting needles and contains a first cutter section, the first cutter needle being located between two abutting knitting needles and including a yarn holding section holding one of the plurality of yarns and the first cutter section connected to the yarn holding section, one of the yarns being picked up to form a pile loop by the yarn holding section and the abutting knitting needles at two sides, the second cutter needle including a second cutter section staggered against the first cutter section in the first yarn cutting displacement to move towards the knitting needle and cut the pile loop.

2. The loop cutting apparatus of claim 1, wherein the first cutter section of the first cutter needle inclines away from the knitting needles.

3. The loop cutting apparatus of claim 2, wherein the first yarn cutting displacement includes a first middle displacement which contains a closed yarn cutting space formed among the first cutter section, the second cutter section and the yarn holding section to hold the yarn.

4. The loop cutting apparatus of claim 1, wherein the first cutter section of the first cutter needle inclines toward the knitting needles.

5. The loop cutting apparatus of claim 4, wherein the first yarn cutting displacement includes a second middle displacement which includes an open yarn cutting space with an upper opening and formed between the first cutter section and the second cutter section to contain one of the yarns.

6. The loop cutting apparatus of claim 1, wherein the second cutter section of the second cutter needle is bent toward the first cutter needle.

7. The loop cutting apparatus of claim 1, wherein the first cutter needle includes a first yarn laying displacement movable towards the knitting needles to place the yarn.

* * * * *